US009934793B2

(12) United States Patent
Bae et al.

(10) Patent No.: US 9,934,793 B2
(45) **Date of Patent: *Apr. 3, 2018**

(54) METHOD FOR DETERMINING ALCOHOL CONSUMPTION, AND RECORDING MEDIUM AND TERMINAL FOR CARRYING OUT SAME

(71) Applicant: Foundation of Soongsil University-Industry Cooperation, Seoul (KR)

(72) Inventors: Myung Jin Bae, Seoul (KR); Sang Gil Lee, Busan (KR); Geum Ran Baek, Seoul (KR)

(73) Assignee: FOUNDATION OF SOONGSIL UNIVERSITY-INDUSTRY COOPERATION, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/113,764

(22) PCT Filed: Jan. 24, 2014

(86) PCT No.: PCT/KR2014/000726
§ 371 (c)(1),
(2) Date: Jul. 22, 2016

(87) PCT Pub. No.: WO2015/111771
PCT Pub. Date: Jul. 30, 2015

(65) Prior Publication Data

US 2017/0004848 A1 Jan. 5, 2017

(30) Foreign Application Priority Data

Jan. 24, 2014 (KR) ..... 10-2014-0008741

(51) Int. Cl.
*G10L 25/66* (2013.01)
*G10L 25/84* (2013.01)
(Continued)

(52) U.S. Cl.
CPC ..... *G10L 25/66* (2013.01); *G10L 25/21* (2013.01); *G10L 25/48* (2013.01); *G10L 25/84* (2013.01)

(58) Field of Classification Search
None
See application file for complete search history.

(56) References Cited

U.S. PATENT DOCUMENTS 5,776,055 A 7/1998 Hayre
5,913,188 A * 6/1999 Tzirkel-Hancock .... G10L 15/02 704/221

(Continued)

FOREIGN PATENT DOCUMENTS

EP 1850328 A1 10/2007
JP 2003-36087 A 2/2003

(Continued)

OTHER PUBLICATIONS

Booklet, Tobias, Korbinian Riedhammer, and Elmar Nöth. "Drink and Speak: On the automatic classification of alcohol intoxication by acoustic, prosodic and text-based features." Twelfth Annual Conference of the International Speech Communication Association. 2011.*

(Continued)

*Primary Examiner* — Pierre-Louis Desir
*Assistant Examiner* — Jonathan Kim
(74) *Attorney, Agent, or Firm* — Novick, Kim & Lee, PLLC; Sang Ho Lee

(57) ABSTRACT

Disclosed are a method for determining whether a person is drunk after consuming alcohol capable of analyzing alcohol (Continued)

consumption in a time domain by analyzing a voice, and a recording medium and a terminal for carrying out same. An alcohol consumption-determining terminal comprises: a voice input unit for generating a voice frame by converting an inputted voice signal and outputting the voice frame; a voiced/unvoiced sound analysis unit for determining whether the voice frame inputted through the voice input unit corresponds to a voiced sound, an unvoiced sound, or background noise; a voice frame energy detection unit for extracting the average energy of voice frames which have been determined as a voiced sound by the voiced/unvoiced sound analysis unit; an interval energy detection unit for detecting the average energy of intervals including a plurality of voice frames which have been determined as voiced sounds; and an alcohol consumption determining unit for determining whether a person is drunk after consuming alcohol by extracting a difference value among the average energy of neighboring intervals which have been detected by the interval energy detection unit, thereby determining whether a person is drunk after consuming alcohol by analyzing the voice signal in a time domain.

14 Claims, 3 Drawing Sheets

(51) Int. Cl.
*G10L 25/48* (2013.01)
*G10L 25/21* (2013.01)

(56) References Cited

U.S. PATENT DOCUMENTS 5,983,189 A * 11/1999 Lee ..... G08B 21/06 704/273
6,006,188 A * 12/1999 Bogdashevsky ..... G10L 17/26 704/270
6,151,571 A * 11/2000 Pertrushin ..... G10L 17/26 704/207
6,205,420 B1 * 3/2001 Takagi ..... G10L 21/04 704/200
6,275,806 B1 * 8/2001 Pertrushin ..... G10L 17/26 704/270
6,446,038 B1 * 9/2002 Bayya ..... G10L 25/69 704/231
6,748,301 B1 6/2004 Ryu
7,283,962 B2 * 10/2007 Meyerhoff ..... G10L 17/26 704/251
7,925,508 B1 4/2011 Michaelis
7,962,342 B1 * 6/2011 Coughlan ..... G10L 15/22 379/201.01
8,478,596 B2 7/2013 Schultz
8,775,184 B2 * 7/2014 Deshmukh ..... G09B 19/04 434/185
8,793,124 B2 * 7/2014 Hidaka ..... G10L 25/00 704/208
8,938,390 B2 * 1/2015 Xu ..... A61B 5/7264 704/231
9,058,816 B2 * 6/2015 Lech ..... G10L 17/26
9,659,571 B2 * 5/2017 Van Der Schaar ..... G08B 3/10
9,672,809 B2 * 6/2017 Togawa ..... G10L 13/027
9,715,540 B2 * 7/2017 Deshmukh ..... G06F 17/30743
2002/0010587 A1 * 1/2002 Pertrushin ..... G10L 17/26 704/275
2002/0194002 A1 * 12/2002 Petrushin ..... G10L 17/26 704/270
2003/0069728 A1 * 4/2003 Tato ..... G10L 17/26 704/231
2004/0167774 A1 * 8/2004 Shrivastav ..... G10L 17/26 704/207
2005/0075864 A1 * 4/2005 Kim ..... G10L 25/48 704/206
2005/0102135 A1 * 5/2005 Goronzy ..... G10L 15/00 704/213
2007/0071206 A1 * 3/2007 Gainsboro ..... H04M 3/2281 379/168
2007/0124135 A1 5/2007 Schultz
2007/0192088 A1 * 8/2007 Oh ..... G10L 15/02 704/209
2007/0213981 A1 * 9/2007 Meyerhoff ..... G10L 17/26 704/243
2007/0288236 A1 * 12/2007 Kim ..... G10L 25/93 704/231
2008/0037837 A1 * 2/2008 Noguchi ..... G06K 9/00335 382/118
2009/0265170 A1 * 10/2009 Irie ..... G10L 17/26 704/236
2010/0010689 A1 1/2010 Yasushi et al.
2011/0035213 A1 2/2011 Malenovsky
2011/0105857 A1 * 5/2011 Zhang ..... G11B 27/034 600/300
2011/0282666 A1 11/2011 Washio
2012/0089396 A1 * 4/2012 Patel ..... G10L 25/00 704/249
2012/0116186 A1 * 5/2012 Shrivastav ..... A61B 5/0507 600/301
2012/0262296 A1 * 10/2012 Bezar ..... G10L 17/26 340/573.1
2013/0006630 A1 * 1/2013 Hayakawa ..... G10L 17/26 704/239
2013/0253933 A1 9/2013 Maruta
2014/0122063 A1 * 5/2014 Gomez Vilda ..... G10L 19/02 704/200.1
2014/0188006 A1 * 7/2014 Alshaer ..... A61B 5/7282 600/586
2014/0244277 A1 * 8/2014 Krishna Rao ..... G06F 19/3418 705/2
2014/0379348 A1 * 12/2014 Sung ..... G10L 25/75 704/254
2015/0127343 A1 5/2015 Mullor et al.
2015/0142446 A1 * 5/2015 Gopinathan ..... G06Q 40/025 704/270
2015/0257681 A1 9/2015 Shuster et al.
2015/0310878 A1 * 10/2015 Bronakowski ..... G10L 25/63 704/246
2015/0351663 A1 12/2015 Zigel
2016/0027450 A1 * 1/2016 Gao ..... G10L 19/22 704/205
2016/0155456 A1 * 6/2016 Wang ..... G10L 25/81 704/208
2016/0379669 A1 12/2016 Bae et al.
2017/0004848 A1 1/2017 Bae et al.

FOREIGN PATENT DOCUMENTS

JP 2010-015027 A 1/2010
JP 5017534 B2 9/2012
KR 10-1997-0038004 A 7/1997
KR 10-0201256 B1 6/1999
KR 10-0206205 B1 7/1999
KR 1999-0058415 A 7/1999
KR 2004-0033783 A 4/2004
KR 10-0497837 B1 6/2005
KR 10-0664271 B1 1/2007
KR 10-2009-0083070 A 8/2009
KR 10-2012-0074314 A 7/2012
WO 2012/014301 A1 2/2012

OTHER PUBLICATIONS

Geumran Baek et al "A Study on Voice Sobriety Test Algorithm in a Time -Frequency Domain" International Journal of Multimedia & Ubiquitous Engineering, vol. 8, No. 5, pp. 395-402, Sep. 2013.
Lee, Won Hui et al. "Valid-frame Distance Deviation of Drunk and non-Drunk Speech" The Journal of Korea Information and Communications Society (winter) 2014, pp. 876-877, Jan. 2014.

(56) References Cited

OTHER PUBLICATIONS

Jung, Chan Joong et al. "A Study on Detecting Decision Parameter about Drinking in Time Domain," The Journal of Korea Information and Communications Society (winter) 2014, pp. 784-785, Jan. 2013.
Geumran Baek et al. "A Study on Judgment of Intoxication State Using Speech," Information and Telecommunication Department, Soongsil University, pp. 277-282.
Seong Geon Bae, Dissertation for Ph.D, "A study on Improving Voice Surveillance System Against Drunk Sailing". Information and Communication Engineering Dept., Soongsil University, Republic of Korea. Dec. 2013. (English Abstract at pp. x-xii).
Seong-Geon Bae et al. "A Study on Personalized Frequency Bandwidth of Speech Signal using Formant to LPC," The Journal of Korean Institute of Communications and Information Sciences (winter), 2013, pp. 669-670.
Seong-Geon Bae et al. "A Study on Drinking Judgement Method of Speech Signal Using the Fomant Deviation in the Linear Prediction Coefficient," he Journal of Korean Institute of Communications and Information Sciences (winter), 2013, pp. 667-668.
Tae-Hun Kim et al. "Drinking Speech System", Department of Information Communication, Sang Myung University, pp. 257-262.
Lee, Won-Hee et al.."A Study on Drinking Judgement using Differential Signal in Speech Signal", The Journal of Korea Information and Communications Society (winter) 2014, pp. 878-879, Jan. 2014.
See-Woo Lee, "A Study on Formant Variation with Drinking and Nondrinking Condition," Department of Information & Telecommunication Engineering, Sangmyung University, vol. 10, No. 4, pp. 805-810, 2009.
Chan Joong Jung et al. "A Study on Drunken Decision using Spectral Envelope Changes" Korea Institute of communications and Information Sciences, Winter Conference, vol. 2013 No. 1 (2013), pp. 674-675.
Chan Joong Jung et al. "Speech Sobriety Test Based on Formant Energy Distribution" International Journal of Multimedia and Ubiquitous Engineering vol. 8 No. 6 (2013), pp. 209-216.
Baumeister, Barbara, Christian Heinrich, and Florian Schiel. "The influence of alcoholic intoxication on the fundamental frequency of female and male speakers." The Journal of the Acoustical Society of America 132.1 (2012): 442-451.
Schuller, Bjorn W., et al. "The INTERSPEECH 2011 Speaker State Challenge." INTERSPEECH. 2011.
Hollien, Harry, et al. "Effects of ethanol intoxication on speech suprasegmentals." The Journal of the Acoustical Society of America 110.6 (2001): 3198-3206.
Kim (Kim, Jonathan, Hrishikesh Rao, and Mark Clements. "Investigating the use of formant based features for detection of affective dimensions in speech." Affective computing and intelligent interaction (2011): 369-377.).
Broad (Broad, David J., and Frantz Clermont. "Formant estimation by linear transformation of the LPC cepstrum." The Journal of the Acoustical Society of America 86.5 (1989)).
Sato (Sato, Nobuo, and Yasunari Obuchi. "Emotion recognition using mel-frequency cepstral coefficients." Information and Media Technologies 2.3 (2007): 835-848.).

* cited by examiner

METHOD FOR DETERMINING ALCOHOL CONSUMPTION, AND RECORDING MEDIUM AND TERMINAL FOR CARRYING OUT SAME

TECHNICAL FIELD

The present invention relates to a method of determining whether a person is drunk after consuming alcohol using voice analysis in the time domain, and a recording medium and terminal for carrying out the same.

BACKGROUND ART

Although there may be differences among individuals, a drunk driving accident is likely to happen when a driver is half-drunk or drunk. As methods of measuring drunkenness, there is a method of measuring the concentration of alcohol within exhaled air during respiration using a breathalyzer equipped with an alcohol sensor and a method of measuring the concentration of alcohol in the blood flow using a laser. Generally, the former method is usually used for cracking down on drunk driving. In this case, when any driver refuses a drunkenness test, the Widmark Equation may be used to estimate a blood alcohol concentration by collecting the blood of the driver with his or her consent.

A technology for determining whether a driver has consumed alcohol and controlled starting device for a vehicle in order to prevent drunk driving is commercialized. Some vehicles to which the technology is applied are already commercially available. Such a technology works by enabling or disabling a vehicle to be started by attaching a detection device equipped with an alcohol sensor to the starting device of the vehicle, this is a field in which much research is being conducted by domestic and foreign automotive manufacturers. These methods use an alcohol sensor and thus may relatively accurately measure a concentration of alcohol. However, in an environment with high humidity and dust, such as an automotive interior environment, the alcohol sensor has a low accuracy and is not entirely usable due to frequent failures. Furthermore, the sensor has a short lifetime. Accordingly, when the sensor is combined to an electronic device, there is an inconvenience of having to repair the electronic device in order to replace the sensor.

DISCLOSURE

Technical Problem

An aspect of the present invention is directed to a method of determining whether a person is drunk after consuming alcohol using voice analysis in the time domain, and a recording medium and terminal for carrying out the same.

Technical Solution

According to an aspect of the present invention, an alcohol consumption determination method includes converting a received voice signal into a plurality of voice frames and extracting average energy for each of the voice frames, dividing the plurality of voice frames into sections with a predetermined length and extracting average energy for a plurality of voice frames included in each of the sections; and comparing the average energy between a plurality of neighboring sections to determine whether alcohol has been consumed.

The converting of a received voice signal into a plurality of voice frames and the extracting of average energy for each of the voice frames may include determining whether each of the plurality of voice frames corresponds to a voiced sound, an unvoiced sound, or background noise and extracting average energy for each voice frame corresponding to the voiced sound.

The comparing of the average energy between a plurality of neighboring sections to determine whether alcohol has been consumed may include setting the neighboring sections to overlap either partially or not at all, extracting average energy for voice frames included in each of the sections, and determining whether a person is drunk after consuming alcohol according to a difference in the extracted average energy.

The comparison of the average energy between a plurality of neighboring sections to determine whether alcohol has been consumed may include determining that alcohol has been consumed when a difference in average energy between the plurality of neighboring sections is less than a predetermined threshold and determining that alcohol has not been consumed when the difference is greater than the predetermined threshold.

According to an embodiment of the present invention, an alcohol consumption determination terminal includes: a voice input unit configured to convert a received voice signal into voice frames and output the voice frames; a voiced/unvoiced sound analysis unit configured to determine whether each of the voice frames corresponds to a voiced sound, an unvoiced sound, or background noise; a voice frame energy detection unit configured to extract average energy of a voice frame that is determined as a voiced sound by the voiced/unvoiced sound analysis unit; a section energy detection unit configured to detect average energy for a section in which a plurality of voice frames determined as voiced sounds are included; and an alcohol consumption determination unit configured to compare average energy between neighboring sections detected by the section energy detection unit to determine whether alcohol has been consumed.

The voiced/unvoiced sound analysis unit may receive a voice frame, extract predetermined features from the voice frame, and determine whether the voice frame corresponds to a voiced sound, an unvoiced sound, or background noise according to the extracted features.

The alcohol consumption determination unit may include a storage unit configured to pre-store a threshold to determine whether alcohol has been consumed and a difference calculation unit configured to calculate a difference in average energy between neighboring sections.

The difference calculation unit may detect an average energy difference between neighboring sections that are set to partially overlap with each other or may detect an average energy difference between neighboring sections that are set not to overlap with each other.

The voice input unit may receive the voice signal through a microphone provided therein or receive the voice signal from a remote site to generate the voice frame.

According to an embodiment of the present invention, a computer-readable recording medium having a computer program recorded thereon for determining whether a person is drunk after consuming alcohol by using the above-described alcohol consumption determination terminal.

Advantageous Effects

As described above, according to an aspect of the present invention, whether alcohol has been consumed may be determined by analyzing an input voice in the time domain.

MODES FOR CARRYING OUT THE INVENTION

Hereinafter, exemplary embodiments of the present invention will be described in detail with reference to the accompanying drawings. In adding reference numbers for elements in each figure, it should be noted that like reference numbers already used to denote like elements in other figures are used for elements wherever possible.

Figure 1:
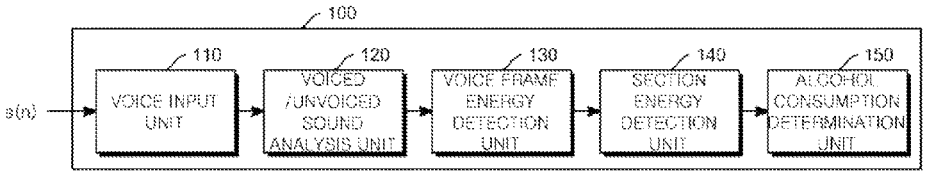
FIG. 1 is a control block diagram of an alcohol consumption determination terminal according to an embodiment of the present invention.

FIG. 1 is a control block diagram of an alcohol consumption determination terminal according to an embodiment of the present invention.

An alcohol consumption determination terminal 100 may include a voice input unit 110 configured to convert received voice signals into voice frames and output the voice frames, a voiced/unvoiced sound analysis unit 120 configured to analyze whether each of the voice frames is associated with a voiced sound or an unvoiced sound, a voice frame energy detection unit 130 configured to detect energy for the voice frame, a section energy detection unit 140 configured to detect energy for a section in which a plurality of voice frames are included, and an alcohol consumption determination unit 150 configured to determine whether alcohol has been consumed using the energy for the section in which the voice frames are included.

The voice input unit 110 may receive a person's voice, convert the received voice into voice data, convert the voice data into voice frames in units of frames, and output the voice frames.

The voiced/unvoiced sound analysis unit 120 may receive a voice frame, extract predetermined features from the voice frame, and analyze whether the voice frame is associated with a voiced sound, an unvoiced sound, or noise according to the extracted features.

The voiced/unvoiced sound analysis unit 120 may determine whether the voice frame corresponds to a voiced sound, an unvoiced sound, or background noise according to a recognition result obtained by the above method. The voiced/unvoiced sound analysis unit 120 may separate and output the voice frame as a voice sound, an unvoiced sound, or background noise according to a result of the determination.

The voice frame energy detection unit 130 may calculate average energy for the voice frame determined as the voiced sound. The average energy is calculated by summing the squares of N samples from short time energy n-N+1 to energy n with respect to sample n, and a detailed description thereof will be provided below.

The section energy detection unit 140 may detect average energy for a section with a predetermined length. The section energy detection unit 140 detects average energy for each of the two neighboring sections.

The alcohol consumption determination unit 150 may calculate a difference in average energy between the two neighboring sections and may determine whether alcohol has been consumed according to the calculated difference.

The alcohol consumption determination unit 150 may compare an average energy difference between the two neighboring sections before drinking and an average energy difference between the two neighboring sections after drinking to determine whether alcohol has been consumed. Here, the average energy difference between the two neighboring sections before drinking may be preset as a threshold and applied in all cases. The threshold may be an optimal value that is set experimentally or customized in advance.

When a person is drunk, his or her ability to control the volume of voice is reduced. Since the person cannot talk smoothly and rhythmically by using a change in energy, the person makes consecutive pronunciations at a loud volume or makes pronunciations at a loud volume when the pronunciation should be made with at a lower volume. Thus, it is determined whether alcohol has been consumed according to an energy change difference in a certain section.

When an energy difference between neighboring sections in a voice frame is smaller than a certain threshold, the alcohol consumption determination unit 150 may determine that alcohol has been consumed.

Figure 2:
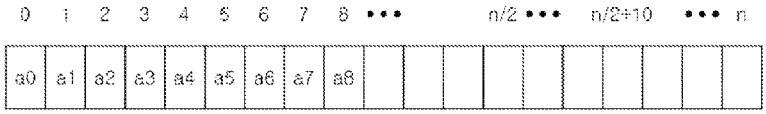
FIG. 2 is a view for describing a concept in which voice signals are converted into voice frames by a voice input unit included in the alcohol consumption determination terminal according to an embodiment of the present invention.

FIG. 2 is a view for describing a concept in which voice signals are converted into voice frames by a voice input unit included in the alcohol consumption determination terminal according to an embodiment of the present invention.

Typically, analog voice signals are sampled at a rate of 8000 per second and in the size of 16 bits (65535 steps) and converted into voice data.

The voice input unit 110 may convert received voice signals into voice data and convert the voice data into voice frame data in units of frames. Here, one piece of the voice frame data has 256 energy values.

As shown in FIG. 2, the voice data is composed of a plurality of voice frames (n=the number of frames, n=1, 2, 3, . . . ) according to an input voice.

The voice input unit 110 generates a voice frame and then sends information regarding the voice frame to the voiced/unvoiced sound analysis unit 120.

Figure 3:
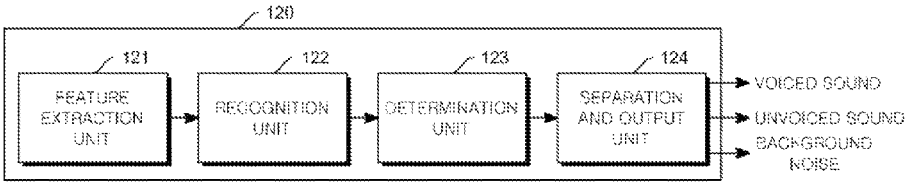
FIG. 3 is a control block diagram of a voiced/unvoiced sound analysis unit included in the alcohol consumption determination terminal according to an embodiment of the present invention.

FIG. 3 is a control block diagram of a voiced/unvoiced sound analysis unit included in the alcohol consumption determination terminal according to an embodiment of the present invention.

The voiced/unvoiced sound analysis unit 120 may include a feature extraction unit 121 configured to receive a voice frame and extract predetermined features from the voice frame, a recognition unit 122 configured to yield a recognition result for the voice frame, a determination unit 123 configured to determine whether the received voice frame is associated with a voiced sound or an unvoiced sound or whether the received voice frame is caused by background noise, and a separation and output unit 124 configured to separate and output the voice frame according to a result of the determination.

When the voice frame is received through the voice input unit 110, the feature extraction unit 121 may extract features such as periodic characteristics of harmonics or root mean square energy (RMSE) or zero-crossing count (ZC) of a low-band voice signal energy area from the received voice frame.

Generally, the recognition unit 122 may be composed of a neural network. This is because the neural network is useful in analyzing non-linear problems, that is, complicated problems that cannot be solved mathematically and thus is suitable for analyzing voice signals and determining whether a corresponding voice signal is a voiced signal, an unvoiced signal, or background noise according to a result of the analysis. The recognition unit 122, which is composed of such a neural network, may assign predetermined weights to the features extracted from the feature extraction unit 121 and may yield a recognition result for the voice frame through a calculation process of the neural network. Here, the recognition result refers to a value that is obtained by calculating calculation elements according to weights assigned to features of each voice frame.

The determination unit 123 may determine whether the received voice signal corresponds to a voiced sound or an unvoiced sound according to the above-described recognition result, that is, the value calculated by the recognition unit 122. The separation and output unit 124 may separate and output the voice frame as a voiced sound, an unvoiced sound, or background noise according to a result of the determination of the determination unit 123.

Meanwhile, since the voiced sound is distinctly different from the voiced sound and the background noise in terms of various features, it is relatively easy to identify the voiced sound, and there are several well-known techniques for this. For example, the voiced sound has periodic characteristics in which harmonics are repeated at a certain interval while the background noise does not have the harmonics. On the other hand, the unvoiced sound has harmonics with weak periodicity. In other words, the voiced sound is characterized in that the harmonics are repeated within one frame while the unvoiced sound is characterized in that the characteristics of the voiced sound such as the harmonics are repeated every certain number of frames, that is, is shown to be weak.

Figure 4:
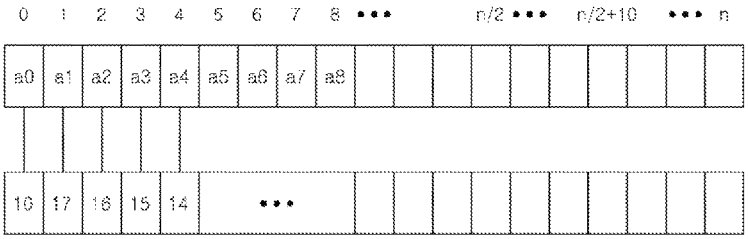
FIG. 4 is a view for describing a section setting operation of a voice frame energy detection unit included in the alcohol consumption determination terminal according to an embodiment of the present invention.

FIG. 4 is a view for describing a section setting operation of a voice frame energy detection unit included in the alcohol consumption determination terminal according to an embodiment of the present invention.

The voice frame energy detection unit 130 may calculate average energy for a voice frame determined as a voiced sound. The average energy is calculated by summing the squares of N samples from short time energy n-N+1 to energy n with respect to sample n, and a detailed description thereof will be provided in the following:

$$E_n = \frac{1}{N} \cdot \sum_{m=n-N+1}^{n} s^2(m). \quad \text{[Equation 1]}$$

Average energy for each of the voice frames determined as voiced sounds may be calculated through Equation 1.

Figure 5A:
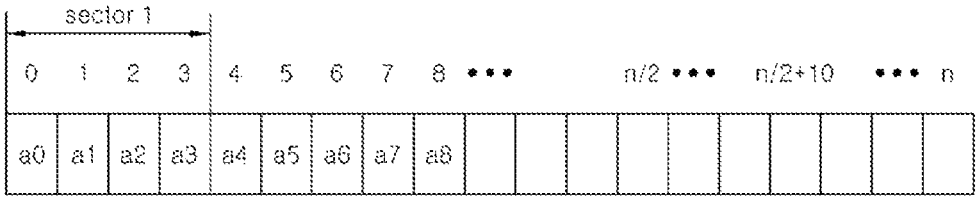
FIGS. 5A and 5B are views for describing a section setting operation of a section energy detection unit included in the alcohol consumption determination terminal according to an embodiment of the present invention.
Figure 5B:
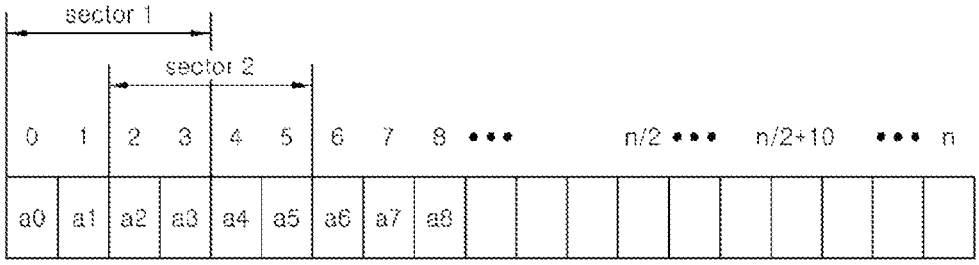
Figure 5C:
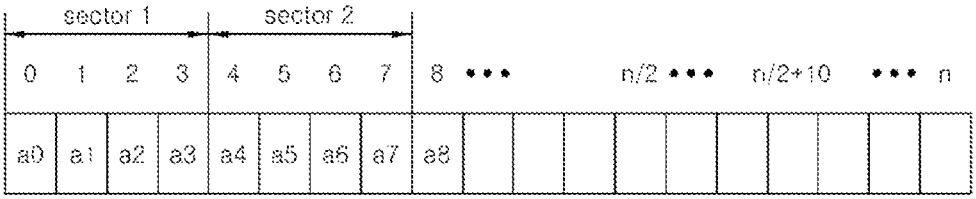

FIGS. 5A to 5C are views for describing a section setting operation of a section energy detection unit included in the alcohol consumption determination terminal according to an embodiment of the present invention.

The section energy detection unit 140 may divide a plurality of voice frames determined as voiced sounds into predetermined sections and may detect average energy for the voice frames included in each of the predetermined sections, that is, average section energy. Since the voice frame energy detection unit 130 calculates average energy for each of the voice frames determined as voiced sounds, the section energy detection unit 140 may detect average section energy using the average energy.

As shown in FIG. 5A, the section energy detection unit 140 may detect average energy for a section with a predetermined length (i.e., sector 1). The section energy detection unit 140 may find average section energy using the following equation:

$$E_d = \frac{1}{F_n} \cdot \sum_{k=1}^{F_n} E_n(k) \quad \text{[Equation 2]}$$

where Fn is the number of voice frames in a section, and En(k) is average energy for a k-th voice frame.

The section energy detection unit 140 may detect average energy for two neighboring sections by using the above-described method. Here, the neighboring sections may be implemented in a form in which the voice frames in a certain section partially overlap with each other as shown in FIG. 5B or in a form in which, starting from a frame next to the last voice frame of a certain section, another section is set as shown in FIG. 5C.

Figure 6:
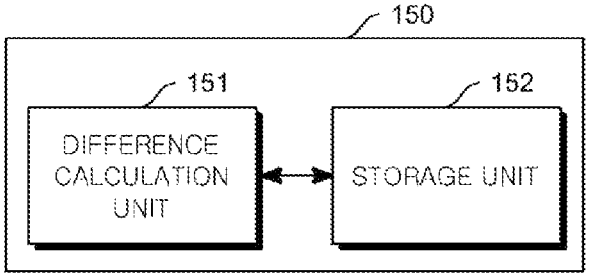
FIG. 6 is a control block diagram of an alcohol consumption determination unit included in the alcohol consumption determination terminal according to an embodiment of the present invention.

FIG. 6 is a control block diagram of an alcohol consumption determination unit included in the alcohol consumption determination terminal according to an embodiment of the present invention.

The alcohol consumption determination unit 150 may include a difference calculation unit 151 configured to calculate a difference in average energy between two neighboring sections and a storage unit 152 configured to prestore a threshold used to determine whether alcohol has been consumed.

The difference calculation unit 151 may calculate the average energy difference between neighboring sections that is transmitted from the section energy detection unit 140 by using the following equation:

$$ER = \alpha \cdot (E_{d1} - E_{d2}) - \beta \quad \text{[Equation 3]}$$

where Ed1 is average energy for any one section including a plurality of voice frames, and Ed2 is average energy for a section neighboring that of Ed1, and also α and β are constant values that may be predetermined to easily recognize the average energy difference.

In the above embodiments, a difference in average energy between the two neighboring sections has been used. However, it will be appreciated that the average energy may be compared by calculating an average energy ratio between two sections according to an embodiment of the present invention. That is, an embodiment of the present invention may include all methods of comparing average energy between two sections to determine whether alcohol has been consumed.

Figure 7:
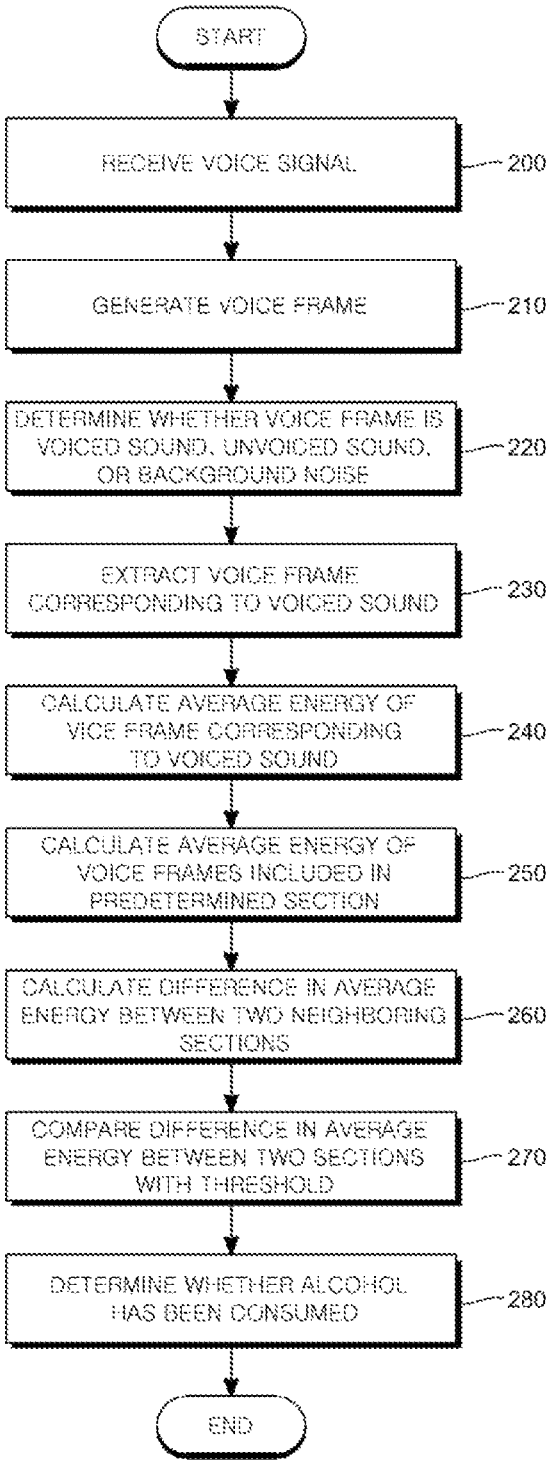
FIG. 7 is a control flowchart showing an alcohol consumption determination method according to an embodiment of the present invention.

FIG. 7 is a control flowchart showing an alcohol consumption determination method according to an embodiment of the present invention.

The voice input unit 110 may receive a voice from the outside. The voice may be received through a microphone (not shown) included in the alcohol consumption determination terminal 100 or may be transmitted from a remote site. A communication unit (not shown) is not shown in the above embodiment. However, it will be appreciated that a communication unit may be provided to transmit a signal transmitted from a remote site or send calculated information to the outside (200).

The voice input unit 110 may convert the received voice into voice data and convert the voice data into voice frame data. The voice input unit 110 may generate a plurality of voice frames for the received voice and transmit the generated voice frames to the voiced/unvoiced sound analysis unit 120 (210).

The voiced/unvoiced sound analysis unit 120 may receive the voice frames, extract predetermined features from each of the voice frames, and determine whether the voice frame corresponds to a voiced sound, an unvoiced sound, or background noise according to the extracted features. The voiced/unvoiced sound analysis unit 120 may extract voice frames corresponding to voiced sounds among the plurality of voice frames that are received (220, 230, and 240).

The voice frame energy detection unit 130 detects average energy for each of the voice frames determined as voiced sounds (250).

The section energy detection unit 140 detects average energy for each of the two neighboring sections. The alcohol consumption determination unit 150 may calculate a difference in average energy between the two neighboring sections and may compare the calculated difference with a predetermined threshold to determine whether alcohol has been consumed. The alcohol consumption determination unit 150 may determine that alcohol has been consumed when the difference in average energy between the two neighboring sections is less than the threshold and may determine that alcohol has not been consumed when the difference in average energy between the two neighboring sections is greater than the threshold (260, 270, 280, and 290).

In the above method, whether alcohol has been consumed is determined by calculating a difference in average energy between the two neighboring sections. It will be appreciated that a method of calculating and comparing differences in average energy between four sections or another number of sections may be used instead of the two neighboring sections. In addition, it will be appreciated that all methods of comparing average energy among a plurality of sections (e.g., a method of calculating a relative ratio of average energy between two neighboring sections rather than the difference in average energy between the two sections) are included.

Furthermore, it will be appreciated that the alcohol consumption method performed by the above-described alcohol consumption determination terminal 100 may be implemented in a computer-readable recording medium having a program recorded thereon.

Although the present invention has been described with reference to exemplary embodiments thereof, it should be understood that numerous other modifications and variations can be made without departing from the spirit and scope of the present invention by those skilled in the art. It is obvious that the modifications and variations fall within the spirit and scope thereof.

The invention claimed is:

1. A method for determining whether alcohol is consumed by a person in a vehicle, the method comprising:

converting a voice signal received from said person in the vehicle into a plurality of voice frames;

extracting predetermined features from a voice frame among the plurality of voice frames;

determining, based on the predetermined features, whether said voice frame is from a voiced sound, an unvoiced sound, or background noise;

extracting a first average energy for each of the voice frames that is determined as the voiced sound, wherein the first average energy is calculated by summing squares of N samples from energy n-N+1 to energy n and dividing by N;

dividing the plurality of voice frames that is determined as the voiced sound into sections with a predetermined length;

calculating a second average energy of the first average energy in each of the sections;

computing a difference of the second average energy between neighboring sections, wherein the neighboring sections does not overlap one another;

determining that alcohol is consumed by said person when the difference is less than a predetermined threshold; and enabling or disabling the vehicle based on the determination.

2. The method of claim 1, wherein the predetermined features comprise root mean square energy (RMSE), or zero-crossing count (ZC) of a low-band voice signal energy area.

3. The method of claim 1, wherein the extracting the first average energy for each of the voice frames comprises extracting the first average energy for each voice frame corresponding to the voiced sound.

4. The method of claim 1, wherein determining that alcohol is consumed by said person comprises:

identifying a section and one or more neighboring sections thereof, computing the difference of the second average energy between the identified sections, and determining whether alcohol is consumed by said person according to the computed difference of the second average energy.

5. The method of claim 4 further comprises:

determining that alcohol is not consumed by said person when the difference is greater than the predetermined threshold.

6. The method of claim 1 further comprising receiving the voice signal which is transmitted from a remote site.

7. The method of claim 1 wherein computing the difference of the second average energy between neighboring sections is calculated by the following equation, $$ER=\alpha\cdot(E_{d1}-E_{d2})-\beta$$

where $E_{d1}$ denotes average energy of a first section in the plurality of voice frames, and $E_{d2}$ denotes average energy for a second section neighboring with the first section, and also $\alpha$ and $\beta$ are predetermined constant values.

8. A non-transitory computer-readable recording medium having a computer program recorded thereon for determining whether alcohol is consumed by a person in a vehicle, the method comprising:

converting a voice signal received from said person in the vehicle into a plurality of voice frames;

extracting predetermined features from a voice frame among the plurality of voice frames;

determining, based on the predetermined features, whether said voice frame is from a voiced sound, an unvoiced sound, or background noise;

extracting a first average energy for each of the voice frames that is determined as the voiced sound, wherein the first average energy is calculated by summing squares of N samples from energy n-N+1 to energy n and dividing by N;

dividing the plurality of voice frames that is determined as the voiced sound into sections with a predetermined length;

calculating a second average energy of the first average energy in each of the sections;

computing a difference of the second average energy between neighboring sections, wherein the neighboring sections does not overlap one another;

determining that alcohol is consumed by said person when the difference is less than a predetermined threshold; and enabling or disabling the vehicle based on the determination.

9. The non-transitory computer-readable recording medium of claim 8, wherein the predetermined features comprise root mean square energy (RMSE), or zero-crossing count (ZC) of a low-band voice signal energy area.

10. The non-transitory computer-readable recording medium of claim 8, wherein the extracting the first average energy for each of the voice frames comprises extracting the first average energy for each voice frame corresponding to the voiced sound.

11. The non-transitory computer-readable recording medium of claim 8, wherein determining that alcohol is consumed by said person comprises:

identifying a section and one or more neighboring sections thereof, computing the difference of the second average energy between the identified sections, and determining whether alcohol is consumed by said person according to the computed difference of the second average energy.

12. The non-transitory computer-readable recording medium of claim 8 further comprises: determining that alcohol is not consumed by said person when the difference is greater than the predetermined threshold.

13. The non-transitory computer-readable recording medium of claim 8 further comprising receiving the voice signal which is transmitted from a remote site.

14. The non-transitory computer-readable recording medium of claim 8 wherein computing the difference of the second average energy between neighboring sections is calculated by the following equation, $$ER=\alpha\cdot(E_{d1}-E_{d2})-\beta$$

where $E_{d1}$ denotes average energy of a first section in the plurality of voice frames, and $E_{d2}$ denotes average energy for a second section neighboring with the first section, and also $\alpha$ and $\beta$ are predetermined constant values.

* * * * *